US009861870B2

(12) United States Patent
Mitton et al.

(10) Patent No.: US 9,861,870 B2
(45) **Date of Patent: *Jan. 9, 2018**

(54) BUTT-END DEVICE OR KNOB FOR A SPORTS IMPLEMENT

(71) Applicant: BPS DIAMOND SPORTS CORP., St-Jèrôme (CA)

(72) Inventors: Ralph Edward Mitton, Ottawa (CA); Frederic St-Laurent, Chelsea (CA); Stephen Fitzgerald, Halifax (CA)

(73) Assignee: EASTON DIAMOND SPORTS, LLC, Thousand Oaks, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/294,429

(22) Filed: Oct. 14, 2016

(65) Prior Publication Data

US 2017/0028281 A1 Feb. 2, 2017

Related U.S. Application Data

(63) Continuation of application No. 14/449,476, filed on Aug. 1, 2014, now Pat. No. 9,468,823.

(30) Foreign Application Priority Data

Jul. 4, 2014 (CA) ..... 2855975

(51) Int. Cl.
*A63B 59/06* (2006.01)
*A63B 59/00* (2015.01)
(Continued)

(52) U.S. Cl.
CPC ..... *A63B 60/16* (2015.10); *A63B 59/0033* (2013.01); *A63B 59/20* (2015.10);
(Continued)

(58) Field of Classification Search
CPC .. A63B 59/06; A63B 59/0014; A63B 59/0029
(Continued)

(56) References Cited

U.S. PATENT DOCUMENTS 1,561,349 A 11/1925 Murphy et al.
2,091,458 A 8/1937 Sleight
(Continued)

FOREIGN PATENT DOCUMENTS

CA 2902159 A1 10/2014

OTHER PUBLICATIONS

Canadian Intellectual Property Office, "Office Action", for Canadian Application No. 2,855,975, dated Sep. 8, 2016, 3 pgs.
(Continued)

*Primary Examiner* — Mark Graham
(74) *Attorney, Agent, or Firm* — Perkins Coie LLP

(57) ABSTRACT

A butt-end device or knob for a sports implement with a handle for holding the sports implement. The butt-end device or knob has an inner member or inner surface mountable adjacent to a longitudinal end of the handle and a hand-engaging surface to engage a user's hand when holding the handle, the hand-engaging surface being movable relative to the handle in order to follow movement of the user's hand when the user swings the sports implement.

20 Claims, 10 Drawing Sheets

(51) Int. Cl.

| | |
|---|---|
| ***A63B 60/16*** | (2015.01) |
| ***A63B 59/50*** | (2015.01) |
| ***A63B 60/22*** | (2015.01) |
| ***A63B 59/20*** | (2015.01) |
| ***A63B 60/08*** | (2015.01) |
| *A63B 102/14* | (2015.01) |
| *A63B 60/12* | (2015.01) |
| *A63B 102/02* | (2015.01) |
| *A63B 102/06* | (2015.01) |
| *A63B 102/20* | (2015.01) |
| *A63B 102/32* | (2015.01) |
| *A63B 69/00* | (2006.01) |

(52) U.S. Cl.
CPC ..... *A63B 59/50* (2015.10); *A63B 60/08* (2015.10); *A63B 60/22* (2015.10); *A63B 60/12* (2015.10); *A63B 69/0002* (2013.01); *A63B 2069/0008* (2013.01); *A63B 2102/02* (2015.10); *A63B 2102/06* (2015.10); *A63B 2102/065* (2015.10); *A63B 2102/14* (2015.10); *A63B 2102/20* (2015.10); *A63B 2102/32* (2015.10); *A63B 2209/02* (2013.01); *A63B 2220/40* (2013.01); *A63B 2220/56* (2013.01); *A63B 2225/50* (2013.01)

(58) Field of Classification Search
USPC ..... 473/457, 519, 520, 552, 513, 560–568, 473/295, 29
See application file for complete search history.

(56) References Cited

U.S. PATENT DOCUMENTS

| | | | | |
|---|---|---|---|---|
| 3,469,839 | A | 9/1969 | Pietronuto et al. | |
| 4,653,754 | A | 3/1987 | Cross | |
| 5,342,046 | A | 8/1994 | Erb et al. | |
| 6,277,040 | B1 | 8/2001 | Randolph et al. | |
| 6,752,731 | B1 | 6/2004 | Kramer et al. | |
| D523,105 | S | 6/2006 | Bernacchi et al. | |
| 7,201,683 | B2 | 4/2007 | Estape et al. | |
| 7,744,497 | B2 | 6/2010 | Phelan et al. | |
| 7,878,930 | B2 | 2/2011 | Leinert et al. | |
| 8,845,462 | B2 | 9/2014 | Chung | |
| 9,468,823 | B2 * | 10/2016 | Mitton ..... | A63B 59/0033 |
| 2012/0135826 | A1 | 5/2012 | Carlson et al. | |
| 2013/0196769 | A1 | 8/2013 | Shocklee et al. | |
| 2014/0274491 | A1 | 9/2014 | Long et al. | |
| 2014/0342854 | A1 | 11/2014 | Thurman et al. | |
| 2015/0065263 | A1 * | 3/2015 | Luttrull ..... | A63B 53/14 473/202 |

OTHER PUBLICATIONS

Canadian Intellectual Property Office, "Examination Report" for CA 2,855,975, dated Oct. 28, 2015, 4 pgs.

* cited by examiner

BUTT-END DEVICE OR KNOB FOR A SPORTS IMPLEMENT

CROSS-REFERENCE TO RELATED APPLICATION(S)

This application is a continuation of U.S. patent application Ser. No. 14/449,476, filed Aug. 1, 2014 and now pending, which claims priority from Canadian Patent Application Serial Number 2,855,975 filed on Jul. 4, 2014. The disclosure of the prior application is hereby incorporated in its entirety by reference.

TECHNICAL FIELD

The invention relates generally to butt-end devices or knobs for sports implements used in performing a swing movement.

BACKGROUND

Sports implements are used in various sports to throw, strike, or otherwise move a ball or other object by performing a swing movement. For example, in softball, a player swings a bat to strike a ball during a game. The bat includes a barrel for striking the ball and a handle for holding the bat. A proximal end region of the bat handle is generally provided with a knob to abut a hand of the player.

Existing knobs are fixed at a predetermined angle with respect to the bat handle such that it is not readily possible for the player to adjust the angle defined by the surface of the knob engaging his/her hand. In some cases, the knob may not be oriented as the player would like and/or is a source of discomfort as the player swings the bat. This may have adverse effects on the player's "feel" of the bat. In addition, existing knobs that define an angle other than a right angle with respect to a longitudinal axis of the bat may not provide the suitable hand-engaging surface angle for each specific player. However, these fixed angled knobs do not enable the batter to use more than one side of the bat. This reduces the life of the bat and the freedom of the player to choose impact location. Similar issues may arise in other sports, such as baseball, golf, lacrosse, tennis, squash, racquetball or cricket, in which players use sticks or other sports implements by performing a swing movement.

SUMMARY

According to a first broad aspect of the invention, there is provided a knob for a sports implement. The knob comprises an inner member and an outer member. The inner member is adapted to be mounted adjacent a proximal end of the sports implement and the outer member is pivotably mounted onto the inner member. The outer member has a hand-engaging surface for engaging a portion of a hand of a player holding the sports implement. In use, the outer member is capable of an angular rotational motion relative to the inner member such that the hand-engaging surface of the outer member abuts and follows the player's hand portion when the player swings the sports implement.

According to another broad aspect of the invention, there is provided a butt-end device for a sports implement. The sports implement comprises a handle for holding the sports implement. The butt-end device comprises an inner surface mountable adjacent to a longitudinal end of the handle; and a hand-engaging surface to engage a user's hand when holding the handle. The hand-engaging surface is movable relative to the handle in order to follow movement of the user's hand when the user swings the sports implement.

According to another broad aspect, the invention relates to a knob or butt-end device configured to be mounted to an implement to perform a swing movement, the knob or butt-end device comprising a hand-engaging surface having a gripping or frictional portion configured to engage with a hand portion of a user to facilitate following of the user's hand during swing movement, the gripping or frictional portion comprising an elastomeric/rubber material or other "high-friction" material, a textured surface (e.g., recesses and/or projections), and/or cushioning for comfort.

According to a further broad aspect, the invention relates to a knob or butt-end device configured to be mounted to an implement to perform a swing movement, the knob or butt-end device comprising a hand-engaging surface configured to engage a hand portion of a user, an adjustment mechanism to make it harder or easier to move (e.g., rotate) the hand-engaging surface, and a lock for selective locking and unlocking the hand-engaging surface to allow and/or prevent its movement and for automatically blocking the hand-engaging surface at a desired or selected point during swing movement.

According to another broad aspect, the invention relates to a knob or butt-end device configured to be mounted to an implement to perform a swing movement, the knob or butt-end device comprising a hand-engaging surface configured to engage a hand portion of a user and a sensor to monitor pressure applied by the user's hand portion on the hand-engaging surface during the user's swing movement, wherein information is conveyed from the sensor to the user to correct or improve the user's swing movement.

According to another broad aspect of the invention, there is provided a ball bat. The ball bat comprises a handle portion for holding and has a proximal end. The ball bat further comprises a barrel portion for striking and a tapered mid-section connecting the handle portion and the barrel portion. The ball bat also comprises a knob. The knob comprises an inner member mounted adjacent the proximal end of the handle portion and an outer member movable relative to the inner member. The outer member comprises a hand-engaging surface for engaging a portion of a hand of a player holding the handle portion. The outer member is configured to rotate relative to the inner member such that the hand-engaging surface follows the player's hand portion when the player swings the ball bat.

According to another broad aspect, the invention provides a ball bat comprising a handle portion for holding and having a proximal end with a knob portion, a barrel portion for striking, a tapered mid-section connecting the handle portion and the barrel portion, and a knob movable relative to the bat knob portion, the knob comprising a hand-engaging surface for engaging a portion of a hand of a player holding the handle portion, wherein the knob is configured to rotate relative to the bat knob portion such that the hand-engaging surface follows the player's hand portion when the player swings the ball bat.

According to a further broad aspect of the invention, there is provided a lacrosse stick. The lacrosse stick comprises a shaft. The shaft comprises a handle portion for holding the lacrosse stick and a knob. The knob comprises an inner member mounted adjacent a proximal end of the handle portion and an outer member movable relative to the inner member. The outer member comprises a hand-engaging surface for engaging a portion of a hand of a player holding the handle portion. The outer member is configured to rotate relative to the inner member such that the hand-engaging surface follows the player's hand portion when the player swings the lacrosse stick.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the accompanying drawings, in which.

It is to be expressly understood that the description and drawings are only for the purpose of illustrating certain embodiments of the invention and are an aid for understanding. They are not intended to be a definition of the limits of the invention.

DETAILED DESCRIPTION

Figure 1:
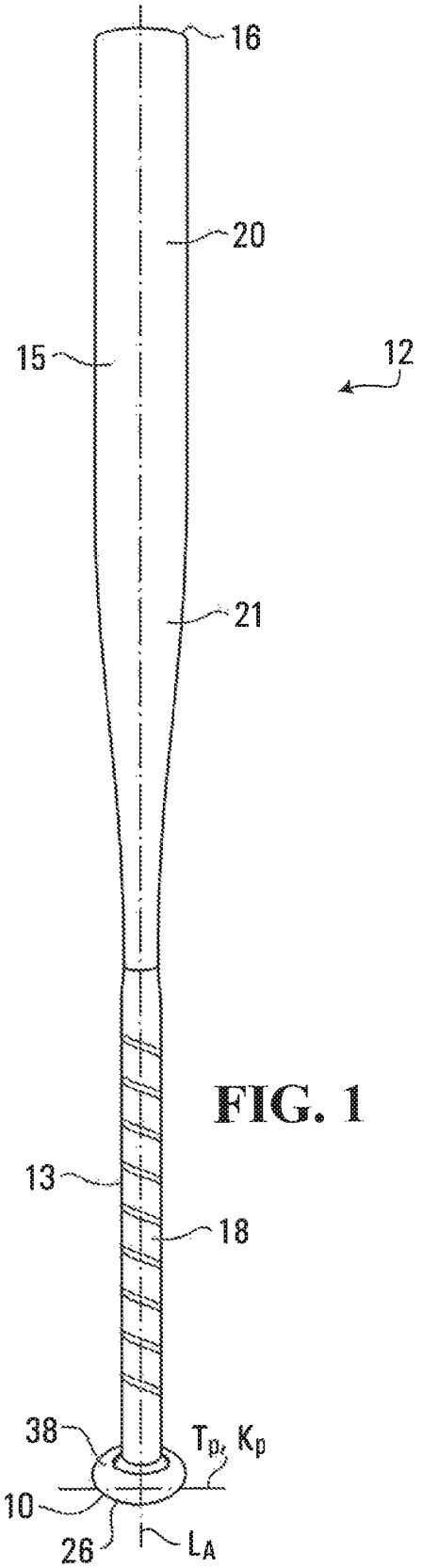
FIGS. 1 and 2 show perspective and elevational views of a bat comprising a knob in accordance with an embodiment of the invention.
Figure 2:
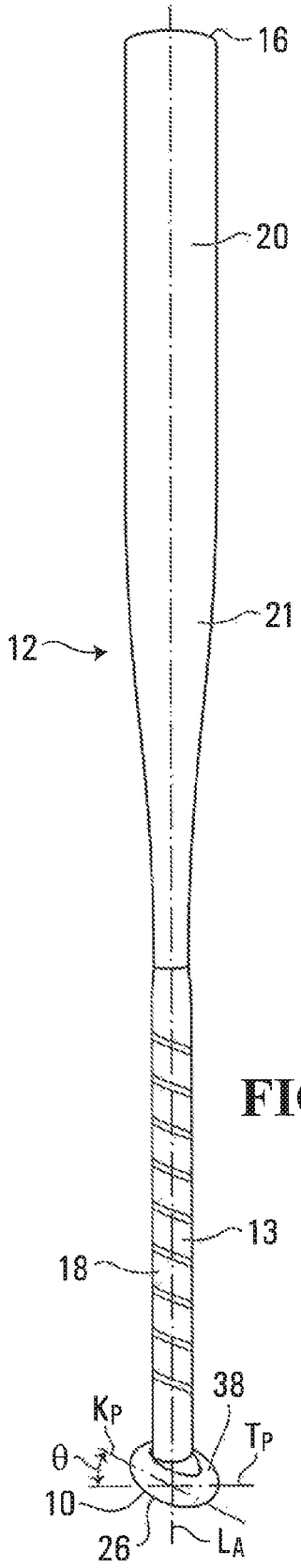

FIGS. 1 and 2 show an example of a sports implement 12 for use by a user (e.g. baseball player, softball player, lacrosse player, etc.) playing a sport. The sports implement 12 comprises a handle portion 13 configured to be held by the player, an object-contacting portion 15 configured to contact an object (e.g., a ball), and a butt-end device 10 mounted to the handle portion 13. The sports implement 12 may be used by the player for striking or otherwise interacting with an object by performing a swing movement. In this embodiment, the sports implement 12 is a ball (e.g. baseball or softball) bat and will thus be referred to as the bat 12. Likewise, in this embodiment, the butt-end device 10 is a knob to be mounted to the bat 12 and will thus be referred to as the knob 10. In other embodiments, the sports implement may be a golf club, a lacrosse stick, a tennis racquet, a squash racquet, a racquetball racquet, a cricket stick or any other suitable sports implement.

The bat 12 comprises a proximal end 14, a handle portion 18 for holding the bat 12, a barrel portion 20 for striking the ball, a tapered mid-section 21 connecting the handle portion 18 to the barrel portion 20, and a distal end 16.

The bat 12 extends along a longitudinal axis LA that runs centrally through the bat 12. The interior of the bat 12 may be hollow in order to reduce its weight. For example the handle portion 18 may be a tubular handle portion and the barrel portion 20 may be a tubular barrel portion. A cap or plug may be affixed adjacent the distal end 16 of the bat 12 in order to close off the barrel portion 20. Although the bat 12 may be a one-piece construction, in other embodiments, the bat 12 may include two or more separate attached pieces. Moreover, as known in the art, the barrel portion 20 and/or the handle portion 18 can be isolated from each other by flexible or resilient connectors of different materials, densities, stiffnesses, and geometries or by a resilient means such as foam, springs, rings, or airbags such that, vibrations generated in the barrel portion 20 are not readily transmitted to the handle portion 18 and are largely damped by the flexible or resilient connectors or resilient means resulting in minimal sting in the player's hands. The barrel portion 20 and/or the handle portion 18 may include a single-wall or multi-wall construction. The barrel portion 20 and/or the handle portion 18 may include a foam core and/or a foam layer. Bat constructions are well-known to those skilled in the art and thus will not be further described here.

The bat 12 may comprise a composite material. More specifically, the composite material comprises a resin matrix which encapsulates reinforcement fibers. The resin may be selected from any of the group consisting of polyester, vinyl ester, vinyl ether, polyurethane, epoxy, cyanate ester, phenolic resinpolyester, polyimide, urethane, nylon, and mixtures thereof. As for the reinforcement fibers, these may be selected from the group consisting of graphite fibers, carbon graphite fibers, aramid fibers, boron fibers, silicon carbide fibers, ceramic fibers, metallic fibers, glass fibers, polypropylene fibers and mixtures thereof. In other examples of implementation, the bat 12 may comprise aluminum, wood (e.g., ash, maple, hickory, bamboo, etc.) or any other suitable material.

Figure 3:
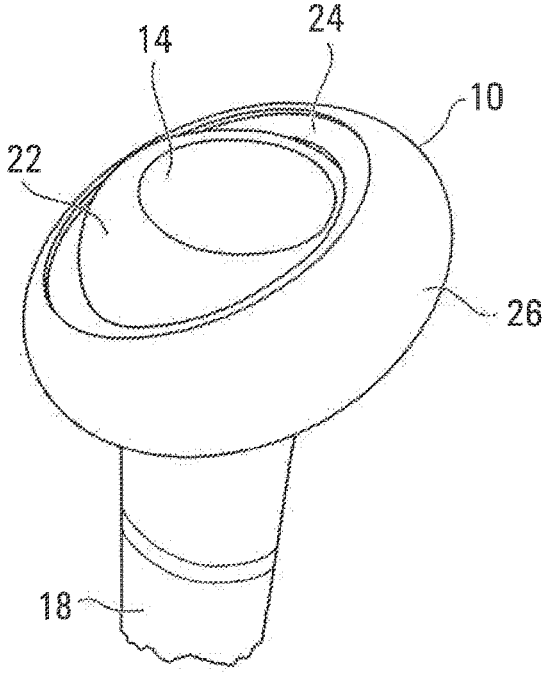
FIG. 3 shows a fragmentary enlarged perspective view of the knob and bat.

As best shown in FIG. 3, the knob 10 is mounted adjacent the proximal end 14 of the handle portion 18 of the bat 12. The knob 10 comprises an inner member 22 configured for being mounted adjacent the proximal end 14 of the handle portion 18 of the bat 12, an outer member 24 movable relative to the inner member 22, and a knob ring 26 that at least partially covers the outer member 24.

In this embodiment, either one or both of the inner and outer members 22, 24 may comprise a low weight material. For example, the low weight material may comprise any plastic material selected from the group consisting of polycarbonate (PC), thermoplastic polyurethane (TPU), polyurethane (PU), high-density polyethylene (HDPE), polyvinyl chloride (PVC), polycarbonate/acrylonitrile butadiene styrene (PC/ABS), polyethylene terephthalate (PET), polyethylene (PE), low-density polyethylene (LDPE), polypropylene (PP), polystyrene (PS), high impact polystyrene (HIPS), polyamides (PA), acrylonitrile butadiene styrene (ABS), melamine formaldehyde (MF), phenolics (PF), polyepoxide (e.g., epoxy), polyetheretherketone (PEEK), polyimide and polymethyl methacrylate (PMMA). In some cases, the plastic material may be fiber-reinforced plastic material (e.g., a polymeric resin reinforced with carbon fibers, aramid fibers or glass fibers). In other embodiments, the inner and outer members 22, 24 may be made of metallic materials or composite materials.

Figure 7:
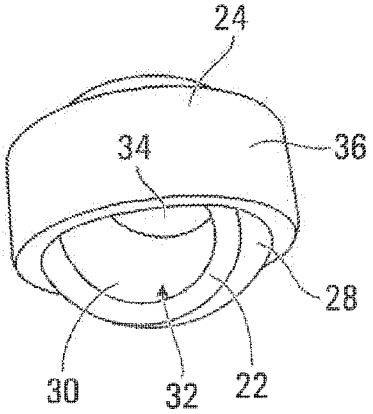
FIG. 7 shows a perspective view of the inner and an outer member of the knob, without the knob ring.

As best shown in FIG. 7, which shows the inner and outer members 22, 24 without the knob ring 26, the inner member 22 comprises an outer surface 28 having a generally spherical shape and an inner surface 30 defining an opening 32 extending through the inner member 22. The opening 32 has a shape complementary to a cross-sectional shape of the bat 12 at the proximal end 14. In this embodiment, the opening 32 of the inner member 22 is a cylindrical opening. The inner member 22 of the knob 10 is mounted to the handle portion 18 of the bat 12 by applying an adhesive between the inner surface 30 and the bat 12 such that the inner member 22 is fixedly mounted to the bat 12. Alternatively, the inner member 22 may be mounted to the bat 12 through a pressure fit, a mechanical fastener or any other suitable method. The outer member 24 comprises inner and outer surfaces 34, 36. The inner surface 34 of the outer member 24 is configured to engage the outer surface 28 of the inner member 22 and is movable relative to the outer surface 28 of the inner member 22 such that the outer member 24 and knob ring 26 can define a plurality of angles with respect to the handle portion 18.

The inner surface 34 of the outer member 24 and the outer surface 28 of the inner member 22 are configured to slide against each other such that the outer member 24 may define an angular rotation about the inner member 22. More specifically, the outer member 24 is configured to define an angular rotation about a central point of the inner member 22. The inner and outer members 22, 24 thus constitute a spherical bearing (also known as a ball joint) where the inner member 22 is an inner race of the spherical bearing and the outer member 24 is an outer race of the spherical bearing. In one embodiment, the spherical bearing may be a lubricant-free spherical plain bearing (i.e., has no rolling elements) and the angular rotation is permitted due to a low-friction material liner comprised by the inner and outer members 22, 24. For example, the inner surface 34 of the outer member 24 and the outer surface 28 of the inner member 22 may comprise a low-friction material such as polytetrafluoroethylene (PTFE or polyethylene/acrylonitrile butadiene styrene (PE/ABS). Moreover, in some embodiments, the inner surface 34 of the outer member 24 and the outer surface 28 of the inner member 22 may go through a surface finishing process (e.g., abrasive blasting) in order to reduce the friction generated between both surfaces. In other embodiments, the spherical bearing may use rolling elements such as a race of ball bearings in order to reduce friction between the inner and outer members 22, 24.

As best seen in FIG. 3, the knob ring 26 has a suitable dimension for at least partially covering the outer surface 36 of the outer member 24 and the knob ring 26 may be permanently or temporarily mounted to the outer member 24.

The knob ring 26 is mounted to the outer member 24 such that the knob ring 26 does not move relative to the outer member 24. In one embodiment, the knob ring 26 may be permanently fixed to the outer member 24 via an adhesive applied between the knob ring 26 and the outer member 24. In other embodiments, the knob ring 26 may be mounted onto the outer member 24 via a pressure fit, a fastener, or any other suitable method. In some embodiments, the knob ring 26 is interchangeable, i.e. is not permanently fixed to the outer member 24. For instance, the knob ring 26 may be changed for a different knob ring having different characteristics (e.g., a different color, design, size, material, etc.).

The knob ring 26 defines a diameter DK of the knob 10. In this embodiment, the diameter DK may be between 1.5 inches and 2.5 inches. Other knob diameters may be used for other sports implements.

The knob ring 26 may comprise a hard plastic body. For example, the hard plastic body of the knob ring 26 may comprise any plastic material selected from the group consisting of polycarbonate (PC), thermoplastic polyurethane (TPU), polyurethane (PU), high-density polyethylene (HDPE), polyvinyl chloride (PVC), polycarbonate/acrylonitrile butadiene styrene (PC/ABS), polyethylene terephthalate (PET), polyethylene (PE), low-density polyethylene (LDPE), polypropylene (PP), polystyrene (PS), high impact polystyrene (HIPS), polyamides (PA), acrylonitrile butadiene styrene (ABS), melamine formaldehyde (MF), phenolics (PF), polyepoxide (e.g., epoxy), polyetheretherketone (PEEK), polyimide and polymethyl methacrylate (PMMA). In some cases, the hard plastic body may comprise fiber-reinforced plastic material (e.g., a polymeric resin reinforced with carbon fibers, aramid fibers or glass fibers).

In other embodiments, the knob ring 26 may be a stretchable sleeve comprising elastomeric material (e.g., rubber). As such, the stretchable sleeve may be removable and interchangeable for another stretchable sleeve according to the player's preference.

As shown in FIGS. 1, 2 and 4A to 4E, the outer member 24 and knob ring 26 define a hand-engaging surface 38 for engaging a portion of the hand of the player holding the handle portion 18 at the proximal end 14 (the left hand for a right-handed batter/player) and the outer member 24 and knob ring 26 are configured to move relative to the inner member 22 in order to define a plurality of angles with respect to the handle portion 18 such that the hand-engaging surface 38 follows the player's hand portion when the player swings the bat 12. It is understood that a portion of the inner member 22 may also engage a portion of the player's hand when the outer member 24 and knob ring 26 rotate during the swing movement of the player.

As best shown in FIGS. 1, 2, 4A and 4B, a fixed transversal plane Tp, which is normal to the longitudinal axis LA of the bat 12, runs through the inner member 22 such that it defines an imaginary plane of the inner member 22 that may bisect the inner member 22 of the knob 10 in two generally identical halves. The outer member 24 and knob ring 26 reside within a knob plane Kp that runs through the outer member 24 and knob ring 26 such that it defines an imaginary plane of the outer member 24 and knob ring 26 that may bisect the outer member 24 and knob ring 26 in two generally identical halves. Since the outer member 24 and knob ring 26 are movable relative to the inner member 22, the knob plane Kp is also movable relative to the transversal plane T.

Figure 4A:
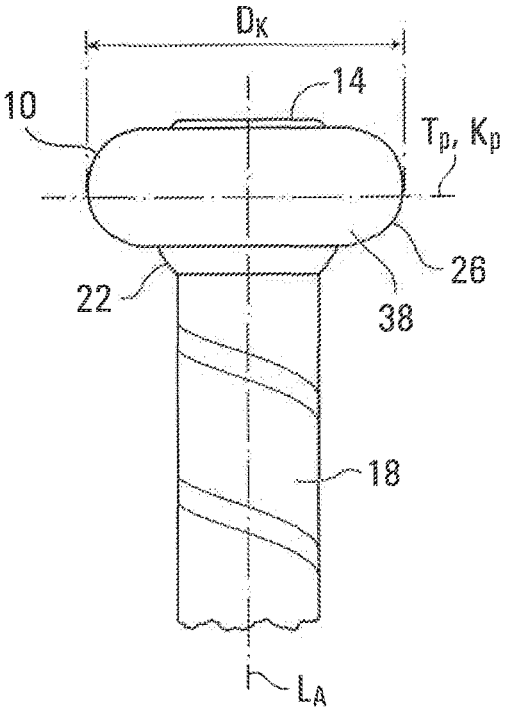
FIGS. 4A to 4E show different angular positions of the knob.
Figure 4B:
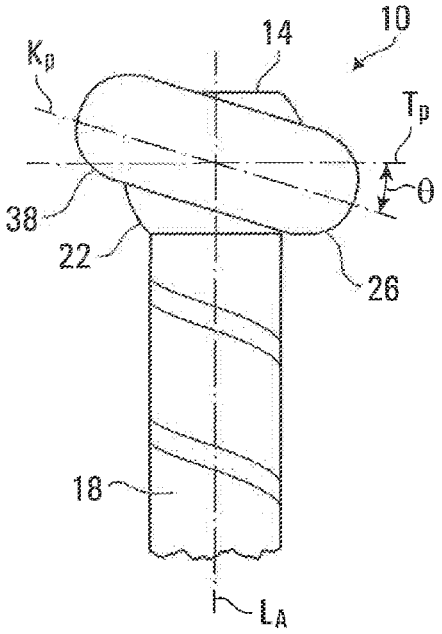
Figure 4C:
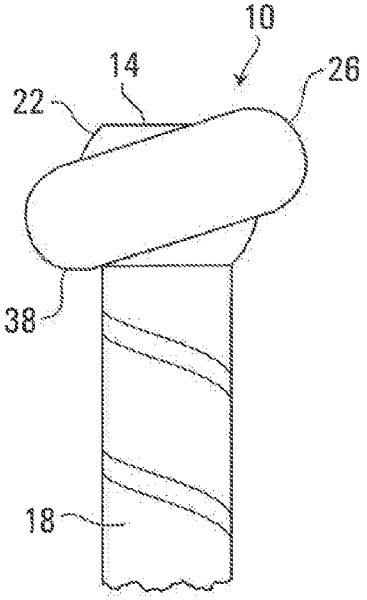
Figure 4D:
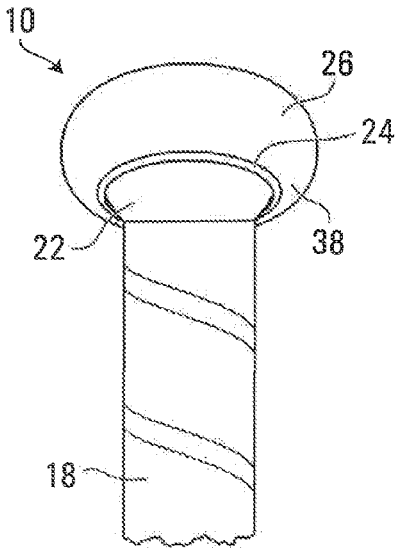
Figure 4E:
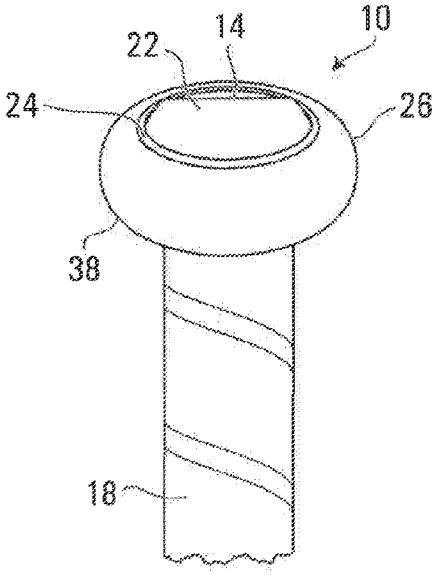
Figure 5:
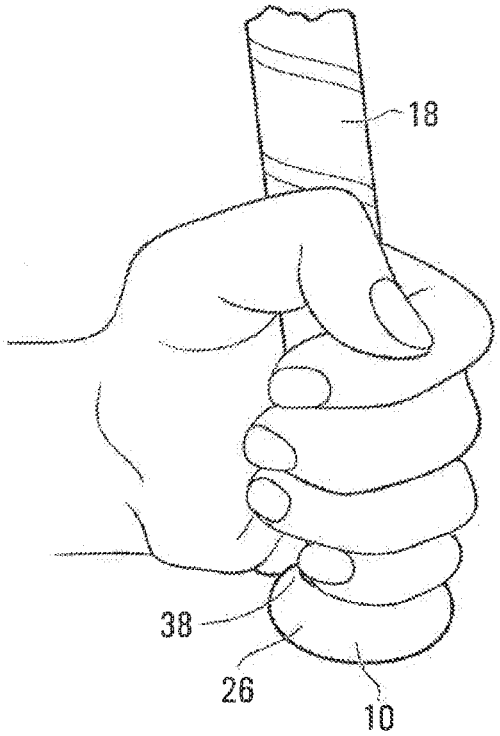
FIGS. 5 and 6 show a hand of a player holding the bat with a portion of the hand engaging the knob (left hand of a right-handed batter)
Figure 6:
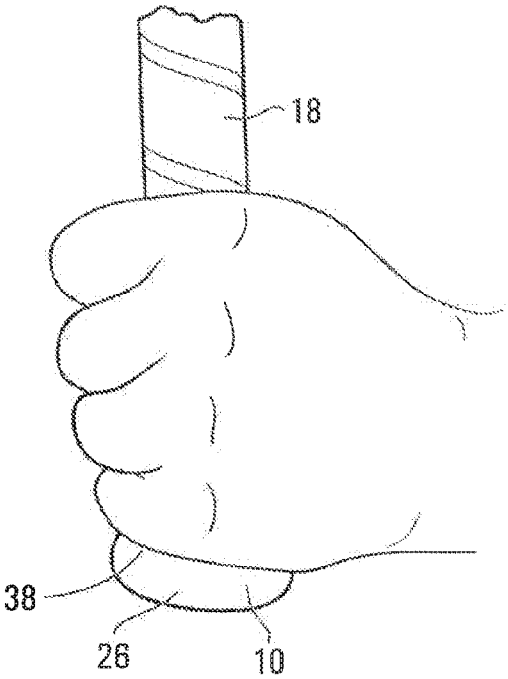

In FIG. 4A, the knob plane Kp coincides with the transversal plane Tp and the outer member 24 and knob rib 26 thus sit perpendicularly to the longitudinal axis LA of the bat 12. In FIG. 4B, the outer member 24 and knob ring 26 is rotated relative to the inner member 22 such that the knob plane Kp defines an angle 0 relative to the transversal plane Tp. The angle 0 may vary from 0° to 20°, from 0° to 30°, from 0° to 40°, from 0° to 60°, or even upwards of 60°. FIGS. 4C to 4E show the outer member 24 and knob 26 in other angular positions.

Figure 8:
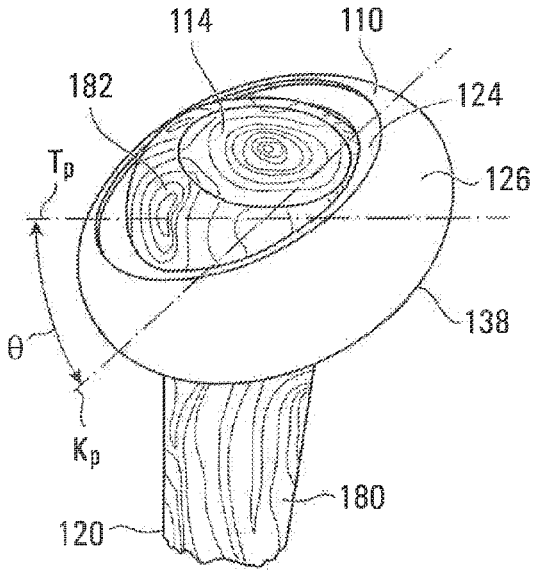
FIG. 8 shows another embodiment of the knob mounted on a bat with a knob portion, the knob comprising an outer member and knob ring.

In another embodiment, as shown in FIG. 8, where the bat is a bat 120 that has an inner member, knob portion or knob 182 integrally formed with the handle portion 180 of the bat 120 at the proximal end 114 (e.g. a wooden bat with a wooden knob), it is understood that the inner member is then omitted and the knob is a knob 110 having an outer member 124 and a knob ring 126 defining a hand-engaging surface 138 for engaging a portion of the hand and the outer member and knob ring 126 are configured to rotate relative to the knob 182 of the bat 120 such that the hand-engaging surface 138 follows the player's hand portion when the player swings the bat 120. It is understood that the fixed transversal plane Tp, which is normal to the longitudinal axis LA of the bat 120, runs through the knob 182 such that it defines an imaginary plane of the knob 182 that may bisect the knob 182 in two generally identical halves. It is also understood that the knob plane Kp runs through the outer member 124 and knob ring 126 such that it defines an imaginary plane of the outer member 124 and knob ring 126 that may bisect the outer member 124 and knob ring 126 in two generally identical halves.

Figure 9:
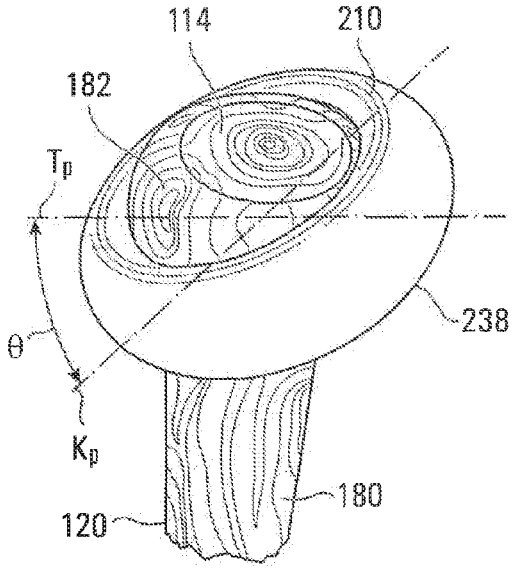
FIG. 9 shows a further embodiment of the knob mounted on a bat with a knob portion, the knob being a single component.

In a further embodiment, as shown in FIG. 9, the knob ring is omitted and the knob is a knob 210 defining a hand-engaging surface 238 for engaging a portion of the hand and the knob 210 is configured to rotate relative to the knob 182 of the bat 120 such that hand-engaging surface 238 follows the player's hand portion when the player swings the bat 120. It is understood that the knob plane Kp runs through the knob 210 such that it defines an imaginary plane of the knob 210 that may bisect the knob 210 in two generally identical halves.

Figure 10:
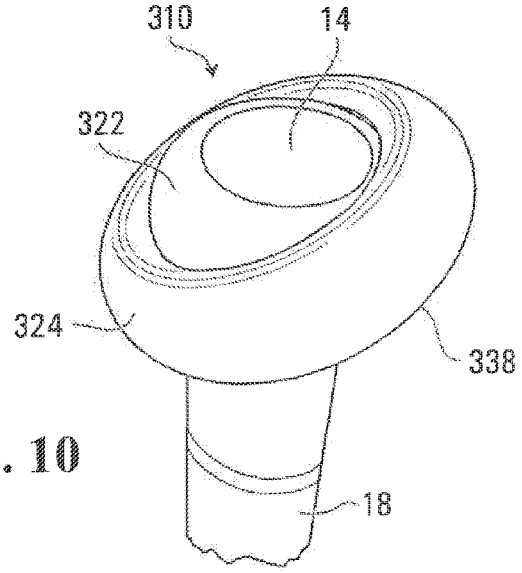
FIG. 10 shows another embodiment of the knob, the knob comprising inner and outer members.

In a further embodiment, as shown in FIG. 10, the knob ring is omitted and the knob is a knob 310 comprising an inner member 322 configured to be mounted adjacent the proximal end 14 of the handle portion 18 and an outer member 324 movable relative to the inner member 322, the outer member 324 defining a hand-engaging surface 338 for engaging a portion of the hand of the player holding the handle portion 18 at the proximal end 14 (the left hand for a right-handed batter/player) and the outer member 324 is configured to move relative to the inner member 322 in order to define a plurality of angles with respect to the handle portion 18 such that the hand-engaging surface 338 follows the player's hand portion when the player swings the bat 12. It is understood that a portion of the inner member 322 may also engage a portion of the player's hand when the outer member 324 rotates during the swing movement of the player. The diameter of the outer member may be between 1.5 inches and 2.5 inches.

Referring to FIGS. 1, 2, 5 and 6, in use, the player holds the bat 12 by holding the handle portion 18 adjacent of the proximal end 14 of the bat such that a portion of one of his/her hands (the left hand for a right-handed batter/player) engages the hand-engaging surface 38. The knob ring 26 is positioned as is most comfortable for the player (i.e. defining the angle 0 he/she prefers). The player then swings the bat 12 in order to strike the ball with the barrel portion 20 of the bat 12. As the player swings the bat 12, the portion of his/her hand which is in contact with the hand-engaging surface 38 moves with respect to the bat 12. This movement of the player's hand portion causes the hand-engaging surface 38, and consequently the knob ring 36 and outer member 24, to dynamically conform to the position of player's hand portion by following the player's hand portion during the player's swing movement. This may improve the "feel" of the bat 12 in the player's hands compared to a fixed knob.

Figure 11:
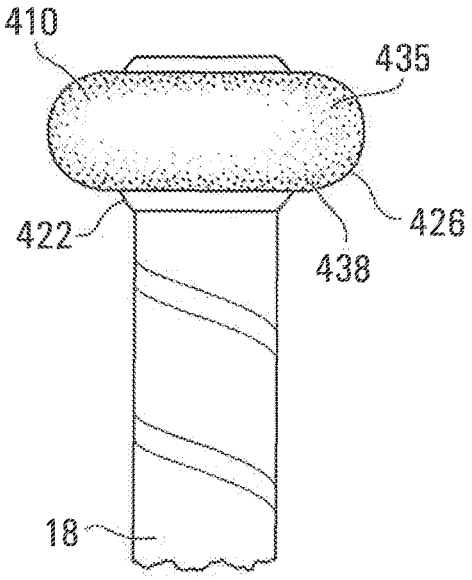
FIG. 11 shows a further embodiment of the knob wherein the knob comprises elastomeric material.

In some embodiments, the knob ring may be configured to provide a grip or frictional engagement with the player's hand in order to facilitate following the player's hand when the player swings the bat 12. For example, as shown in FIG. 11, in a further embodiment, the knob is a knob 410 comprising an inner member 422, an outer member (not shown), and a knob ring 426 comprising a hand-engaging surface 438. The hand-engaging surface 438 of the knob ring 426 comprises an elastomeric material 435 for frictionally engaging the player's hand. For instance, the elastomeric material 435 may be rubber or any other suitable high-friction material.

Additionally, in some embodiments, the hand-engaging surface 438 of the knob ring 426 may comprise a cushioning material for providing cushioning properties to the hand-engaging surface 438. For example, the elastomeric material 435 may achieve the dual purpose of providing an improved grip and the desired cushioning properties. In other embodiments, the cushioning material may comprise foam or any other suitable cushioning material.

Figure 12:
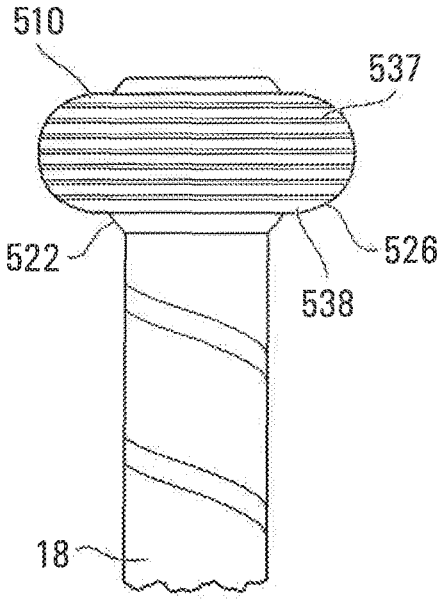
FIG. 12 shows another embodiment of the knob wherein the knob comprises a plurality of grip-enhancing recesses provided on the knob ring.

In a further embodiment, as shown in FIG. 12, the knob is a knob 510 comprising an inner member 522, an outer member (not shown) and a knob ring 526 comprising a hand-engaging surface 538. The hand-engaging surface 538 of the knob ring 526 comprises a textured surface. For example, the hand-engaging surface 538 comprises grooves 537 extending around the periphery of the hand-engaging surface 538 for providing a better grip. In other examples, the hand-engaging surface 538 may comprise other types of recesses or protrusions. For instance, in some embodiments, the hand-engaging surface 538 may define small circular protrusions or recesses. The protrusions or recesses of the hand-engaging surface 538 may be implemented in any other suitable way.

Figure 13:
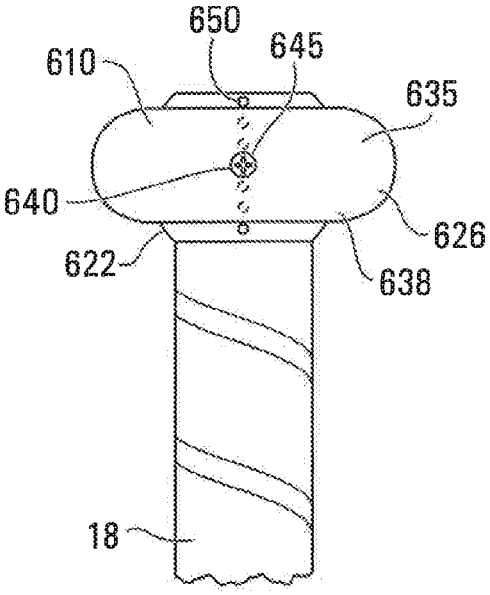
FIGS. 13 and 14 show elevational and top views of a further embodiment of the knob wherein the knob comprises a locking mechanism.
Figure 14:
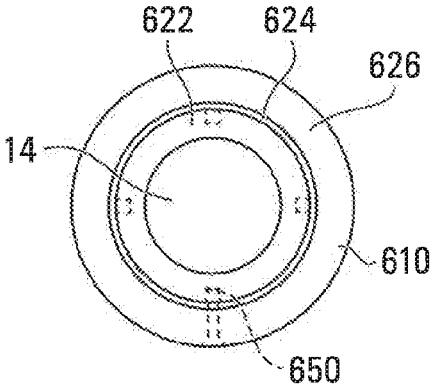

In some embodiments, the knob may comprise a locking mechanism for selectively locking and unlocking the hand-engaging surface of the knob. For instance, FIGS. 13 and 14 show elevational and top views of a further embodiment wherein the knob is a knob 610 comprising an inner member 622, an outer member 624 and a knob ring 626 comprising a hand-engaging surface 638. The knob 610 further comprises a locking mechanism 640 which permits the player to selectively lock and unlock the hand engaging surface 638 to a position of his/her preference. The locking mechanism 640 comprises a set screw 645 operable to engage a hole traversing the knob ring 626 and the outer member 624, and threaded holes 650 provided in the inner member 622. The set screw 645 is operable to selectively engage one of the threaded holes 650 provided in the inner member 622. By engaging one of the threaded holes 650, the set screw 645 effectively locks the outer member 624 to the inner member 622 and thus prevents the hand-engaging surface 638 from moving. The set screw 645 and the threaded holes 650 may be configured in any other suitable manner (e.g., the threaded holes 650 may be provided at different intervals along the inner member 622).

Figure 15:
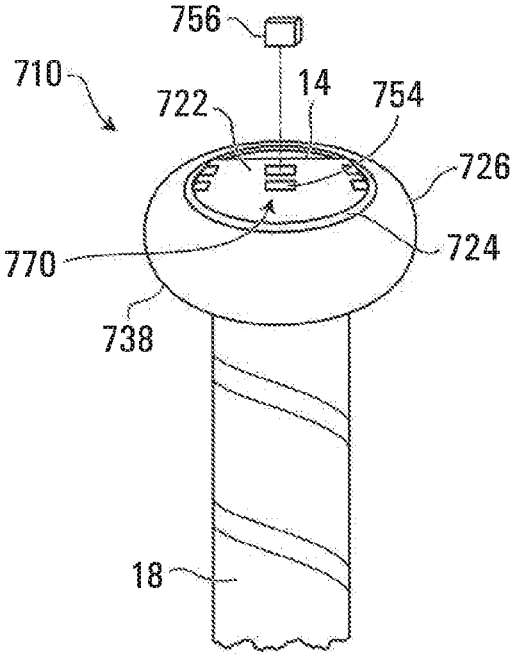
FIG. 15 shows an elevational view of another embodiment of the knob wherein the knob comprises a limit mechanism.

In some embodiments, the knob may comprise a limit mechanism for automatically blocking the hand-engaging surface of the knob at a desired selected point while the player swings the bat 12. For instance, FIG. 15 shows an elevational view of an embodiment wherein the knob is a knob 710 comprising an inner member 722, an outer member 724 and a knob ring 726 comprising a hand-engaging surface 738. The knob 710 further comprises a limit mechanism 770 for limiting a range of movement of the hand-engaging surface 738. The limit mechanism 770 comprises a series of slots 754 traversing the inner member 722, and one or more inserts 756 for engaging the slots 754. The insert 756 is configured for being inserted in a slot 754 such that, when inserted, the insert 756 protrudes from an outer surface of the inner member 722 thus creating an obstacle for the angular rotation of the outer member 724 and the knob ring 726 about the inner member 722. The hand-engaging surface 738 is thus free to rotate about the longitudinal axis LA of the bat 12 but is limited to a certain range of angular rotation about the inner member 722 (i.e., is not able to rotate the full extent of angle 0) which depends on the slot 754 which the insert 756 engages. The limit mechanism 770 may be configured differently in other embodiments. For example, the slots may be distributed differently throughout the inner member and may include a different number of slots.

Figure 16:
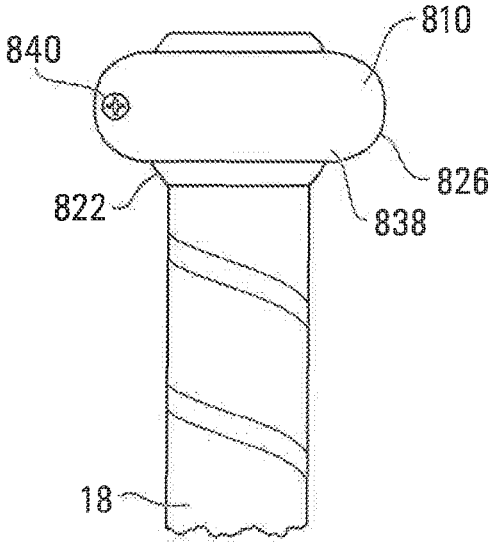
FIGS. 16 and 17 show elevational and top views of a further embodiment of the knob wherein the knob comprises an adjustment mechanism.
Figure 17:
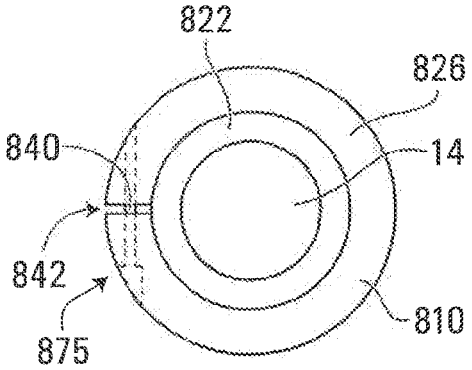

In some embodiments, the knob may comprise an adjustment mechanism for making it harder or easier to move the hand-engaging surface. For instance, FIGS. 16 and 17 show elevational and top views of a further embodiment wherein the knob is a knob 810 comprising an adjustment mechanism 875. The knob 810 comprises an inner member 822 and a knob ring 826 comprising a hand-engaging surface 838. The knob ring 826 engages the inner member 822 directly, i.e. without an intervening outer member, and is slideably moveable relative to the inner member 822. The knob ring 826 is also configured to function as a clamp. The adjustment mechanism 875 of the knob 810 consists of the clamp 826 which comprises a fastener 840 and an opening 842. In this example, the fastener 840 is a screw and is operable to engage a through hole on one side of the opening 842 and a threaded hole aligned with the through hole on the other side of the opening 842. As the fastener 840 is screwed into the threaded hole, the walls on each side of the opening 842 are brought closer together. Consequently, the clamp applies an increasing compressive force on the inner member 822 as the fastener 840 is screwed into the threaded hole of the clamps 826. This makes it harder to rotate the hand-engaging surface 838 of the clamp 826 about the inner member 822. Conversely, loosening the fastener 840 reduces the compressive force applied on the inner member 822 and thus permits an easier rotation of the hand-engaging surface 838 of the clamp 826 about the inner member 822.

In some cases, the knob may also be used to obtain feedback regarding a player's performance with the bat 12. This may be useful when the player is using the bat 12 for training purposes and desires to obtain performance-related feedback so as to improve or correct his/her swing.

Figure 18:
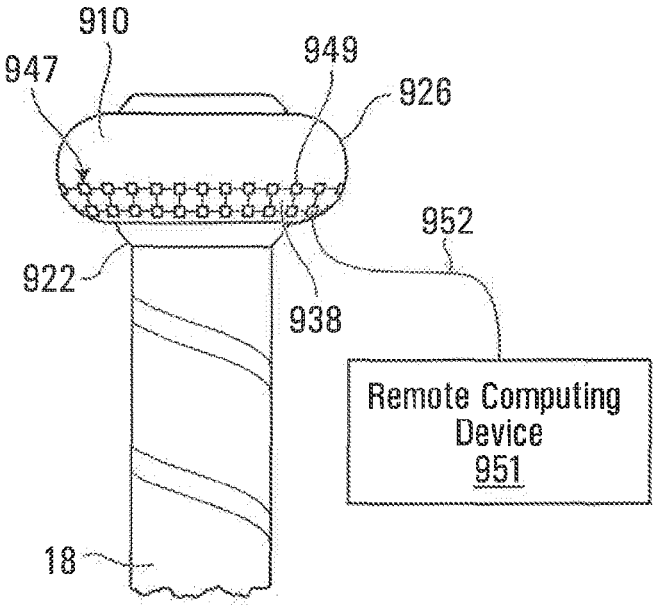
FIG. 18 shows an elevational view of another embodiment of the knob wherein the knob comprises a sensor.

For instance, as shown in FIG. 18, in a further embodiment, the knob is a knob 910 comprising an inner member 922, an outer member (not shown), a knob ring 926 comprising a hand-engaging surface 938, and a sensor 947 disposed on the hand-engaging surface 938. The sensor 947 is configured for measuring a physical quantity and comprises sensor elements 949 distributed throughout the hand-engaging surface 938. In this example of implementation, the sensor 947 is a pressure sensor and the sensor elements 949 thus detect a pressure applied on the hand-engaging surface 938. When the player swings the bat 12, as the positioning of the player's hand changes, the sensor 947 detects the pressure applied on the hand-engaging surface 938 of the knob 910. The information gathered by the sensor 947 may then be relayed to a remote computing device 951 in the form of a signal through a connection 952. Once the information has been transferred to the remote computing device 951, the player or another person may analyze the information to evaluate the player's swing.

The remote computing device 951 may be implemented in a variety of ways. For example, the remote computing device 951 may be a desktop computer, a laptop or a mobile device (e.g., a smartphone or a tablet) belonging to the player. In some cases, the remote computing device 951 may not necessarily belong to the player but rather to a person with an interest in the player's performance such as a coach, a trainer, a physician, a parent, etc.

In some embodiments, the connection 952 may be a wired connection such as, for example, a USB connection or a mini-USB connection. In other embodiments, the connection 952 may be a wireless connection. For example, the connection 952 may be implemented as a Bluetooth, infrared, WiFi, or cellular data connection.

The sensor 947 may be implemented in various other ways. For example, the sensor 947 may be an accelerometer configured to measure an acceleration of the knob 910. The sensor 947 may be any other type of suitable sensor.

Figure 19:
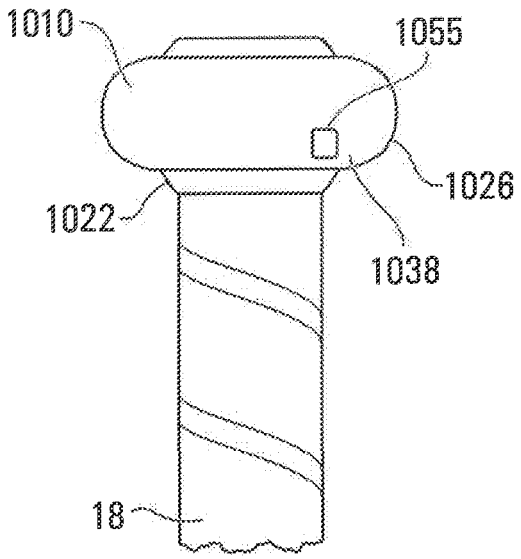
FIG. 19 shows an elevational view of a further embodiment of the knob wherein the knob comprises another sensor.

In a further embodiment, as shown in FIG. 19, the knob is a knob 1010 comprising an inner member 1022, an outer member (not shown), a knob ring 1026 comprising a hang-engaging surface 1038, and a sensor 1055 (e.g., a mechanical sensor) configured to visually or audibly alert the player to a specific event. For example, the sensor 1055 may emit or produce a signal (e.g. sound) only when a selected angle 0 of the knob 1010 is reached such that the player is aware when he/she has reach his/her optimum wrist angle/flexion during the swing movement. As described previously, in another embodiment, the signal may be relayed to a remote computing device through a connection. Once the signal has been transferred to the remote computing device, the player or another person may analyze the information to evaluate the player's swing.

While the butt-end device 10 has been described as the knob 10 of a bat 12, it is to be expressly understood that features taught in respect of the knob 10 may similarly apply to other sports implements which are used by performing a swing movement.

This includes baseball bats, golf clubs, lacrosse sticks, tennis racquets, squash racquets, racquetball racquets, cricket sticks or any other suitable sports implements.

Figure 20:
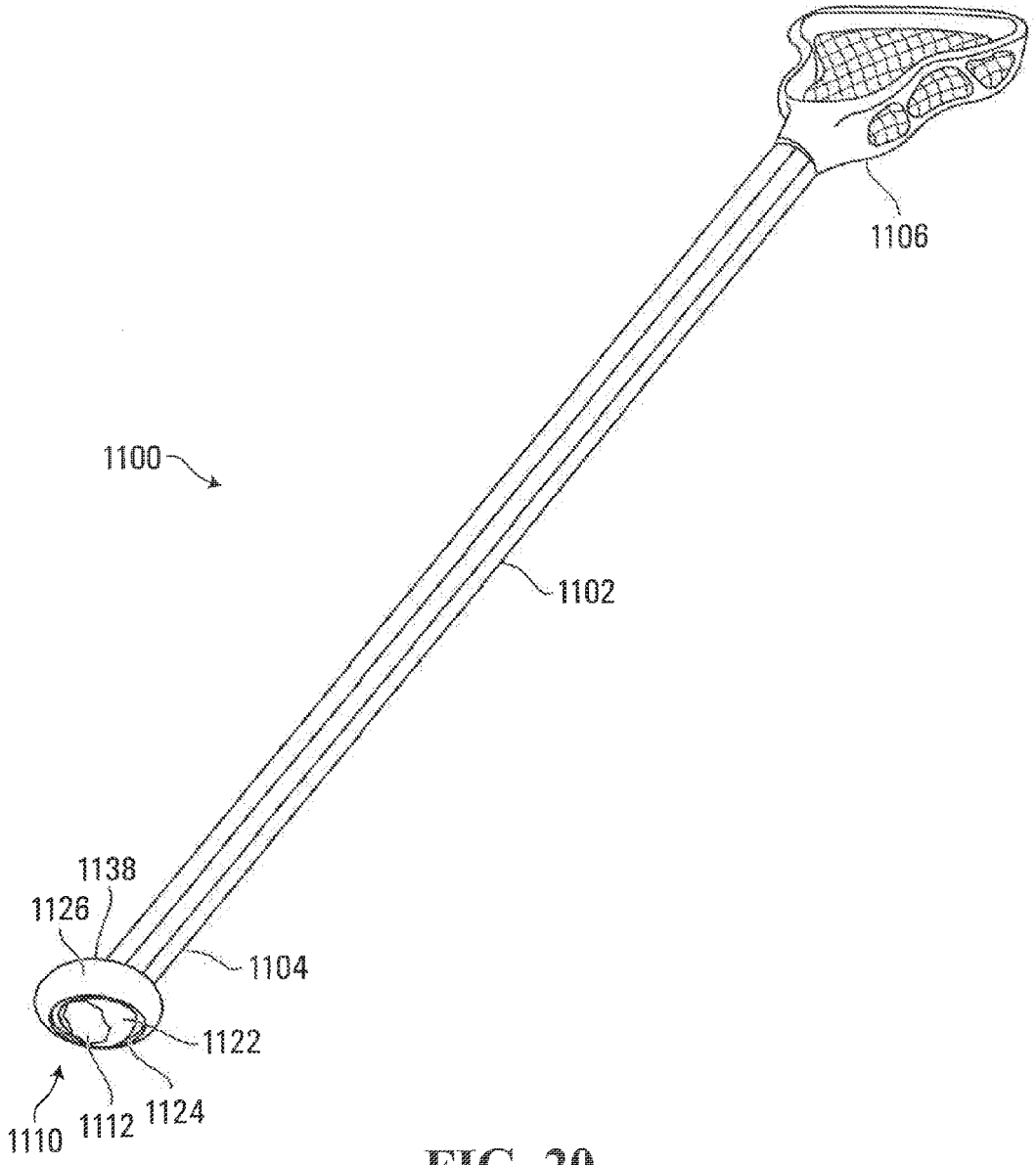
FIG. 20 shows a perspective view of another embodiment of the knob wherein the knob is mounted on a lacrosse stick.

For example, with reference to FIG. 20, in a variant of the invention, a lacrosse stick 1100 comprises a similarly constructed knob 1110. The lacrosse stick 1100 comprises a shaft 1102 and a head 1106. The shaft 1102 comprises a handle portion 1104 for holding by the player. The head 1106 allows the player to catch or throw a ball. The knob 1110 is mounted adjacent a proximal end 1112 of the handle portion 1104 such as to engage a hand of the player holding the handle portion 1104.

The knob 1110 comprises an inner member 1122 for mounting to the shaft 1102, an outer member 1124 for engaging and rotating about the inner member 1122, and a knob ring 1126 mounted to the outer member 1124. The knob ring 1126 comprises a hand-engaging surface 1138 for engaging the hand of the player. The inner member 1122 comprises an opening having a shape complementary to a cross-sectional shape of the shaft 1102. More specifically, in this embodiment, the shape of the opening of the inner member 1122 is generally octagonal.

Although in this embodiment the knob ring 1126 of the knob 1110 has a rounded shape, in other embodiments, the knob ring 1126 of the knob 1110 may have any other suitable outer peripheral shape (e.g., angular or polygonal).

The features discussed above in respect of other embodiments of the knob may similarly apply to the knob 1110. For example, the knob may not comprise a knob ring at all and may instead comprise an outer member comprising a hand-engaging surface. In another example, the inner member may be an inner member, knob portion or knob integrally formed with the handle portion of the shaft at the proximal end 1104.

Any feature of any embodiment discussed herein may be combined with any feature of any other embodiment discussed herein in some examples of implementation.

Certain additional elements that may be needed for operation of certain embodiments have not been described or illustrated as they are assumed to be within the purview of those of ordinary skill in the art. Moreover, certain embodiments may be free of, may lack and/or may function without any element that is not specifically disclosed herein.

Although various embodiments and examples have been presented, this was for the purpose of describing, but not limiting, the invention. Various modifications and enhancements will become apparent to those of ordinary skill in the art and are within the scope of the invention, which is defined by the appended claims.

The invention claimed is:

1. A ball bat comprising a handle for holding the ball bat, a barrel portion attached to the handle, and a butt-end device, the butt-end device comprising:

an outer member pivotable relative to a longitudinal end of the handle about a plurality of axes, the outer member having a hand-engaging surface that enables movement of the butt-end device corresponding to movement of a user's hand when the user swings the ball bat.

2. The ball bat of claim 1, wherein the butt-end device further comprises an inner member mounted to the longitudinal end of the handle, wherein the outer member is movable relative to the inner member when the user swings the ball bat.

3. The ball bat of claim 2 wherein the outer member and the inner member form a spherical bearing.

4. The ball bat of claim 1, wherein the butt-end device further comprises a ring mounted onto the outer member.

5. The ball bat of claim 4 wherein the ring is a first ring and is interchangeable with a second ring.

6. The ball bat of claim 4 wherein the ring includes a cushioning material or a textured surface.

7. A lacrosse stick comprising a handle for holding the lacrosse stick, a head attached to the handle, and a butt-end device, the butt-end device comprising:

an outer member pivotable relative to a longitudinal end of the handle about a plurality of axes, the outer member having a hand-engaging surface that enables movement of the butt-end device corresponding to movement of a user's hand when the user swings the lacrosse stick.

8. The lacrosse stick of claim 7, wherein the butt-end device further comprises an inner member mounted to the longitudinal end of the handle, wherein the outer member is movable relative to the inner member when the user swings the lacrosse stick.

9. The lacrosse stick of claim 8 wherein the outer member and the inner member form a spherical bearing.

10. The lacrosse stick of claim 7, wherein the butt-end device further comprises a ring mounted onto the outer member.

11. The lacrosse stick of claim 10 wherein the ring is a first ring and is interchangeable with a second ring.

12. The lacrosse stick of claim 10 wherein the ring includes a cushioning material or a textured surface.

13. A butt-end device for a sports implement, the sports implement comprising a handle for holding the sports implement, the handle having a proximal end, the butt-end device comprising:

an inner member mounted to the proximal end; and an outer member positioned to encircle the inner member, the outer member being pivotable about the inner member and about a plurality of axes to enable movement of the outer member corresponding to movement of a user's hand when the user swings the sports implement, wherein the inner member extends through and extends out of the outer member.

14. The butt-end device of claim 13 wherein the inner member is integrally formed with the handle.

15. The butt-end device of claim 13 wherein the inner member is affixed to the proximal end via an adhesive or pressure fit.

16. The butt-end device of claim 13 wherein the inner member and the outer member form a spherical bearing.

17. The butt-end device of claim 13, further comprising a ring mounted onto the outer member.

18. The butt-end device of claim 17 wherein the ring includes a cushioning material or a textured surface.

19. The butt-end device of claim 13, further comprising a mechanism positioned to selectively resist movement of the outer member relative to the inner member.

20. The butt-end device of claim 13, further comprising a sensor element positioned to detect movement of the butt-end device or a force applied to the surface of the outer member.

* * * * *